US010428810B2

(12) United States Patent
Ha et al.

(10) Patent No.: US 10,428,810 B2
(45) Date of Patent: Oct. 1, 2019

(54) LINEAR COMPRESSOR HAVING RADIAL STOPPERS

(71) Applicant: LG ELECTRONICS INC., Seoul (KR)

(72) Inventors: Dongkyun Ha, Seoul (KR); Yunhyeok Yu, Seoul (KR); Jongwoo Lee, Seoul (KR); Gyeoungjin Jeon, Seoul (KR); Wonhyun Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 178 days.

(21) Appl. No.: 15/498,694

(22) Filed: Apr. 27, 2017

(65) Prior Publication Data

US 2017/0321674 A1 Nov. 9, 2017

(30) Foreign Application Priority Data

May 3, 2016 (KR) ..... 10-2016-0054910

(51) Int. Cl.
*F04B 35/04* (2006.01)
*F04B 19/22* (2006.01)
(Continued)

(52) U.S. Cl.
CPC ..... *F04B 39/0044* (2013.01); *F04B 17/04* (2013.01); *F04B 19/22* (2013.01);
(Continued)

(58) Field of Classification Search
CPC ..... F04B 39/0044; F04B 39/0061; F04B 39/127; F04B 39/0027; F04B 53/003
See application file for complete search history.

(56) References Cited

U.S. PATENT DOCUMENTS 4,416,594 A * 11/1983 Ichikawa ..... F04B 39/127 248/606
4,632,645 A * 12/1986 Kawakami ..... F04B 35/045 310/27

(Continued)

FOREIGN PATENT DOCUMENTS

CN 1766322 5/2006
CN 104251195 12/2014

(Continued)

OTHER PUBLICATIONS

Chinese Office Action dated Jul. 31, 2018.
European Search report dated Oct. 9, 2017 EP 17169044.9.

*Primary Examiner* — Bryan M Lettman
*Assistant Examiner* — Timothy P Solak
(74) *Attorney, Agent, or Firm* — Ked & Associates LLP

(57) ABSTRACT

A linear compressor is provided that may include a compressor casing including a cylindrical shell and a pair of shell that covers both ends of the shell; a frame fixed to an inside of the shell; a cylinder accommodated in the shell and defining a compression space for a refrigerant; a piston inserted into the cylinder to linearly reciprocate in an axial direction of the cylinder and compress the refrigerant provided to the compression space; a motor assembly including a motor that provides power for a linear reciprocating motion to the piston, and a motor support that supports the motor; a spring that allows a resonant motion of the piston; a back cover that supports the spring; and a stopper provided in one of the pair of shell covers and contacting the back cover when the motor assembly vibrates in a radial direction of the cylinder, thereby preventing the motor assembly from colliding with the shell.

16 Claims, 13 Drawing Sheets

(51) Int. Cl.
*F04B 17/04* (2006.01)
*F04B 39/00* (2006.01)
*F04B 39/12* (2006.01)

(52) U.S. Cl.
CPC ..... *F04B 35/045* (2013.01); *F04B 39/121* (2013.01); *F04B 39/127* (2013.01)

(56) References Cited

U.S. PATENT DOCUMENTS

| | | | | | |
|---|---|---|---|---|---|
| 6,132,183 | A * | 10/2000 | Li | F04B 39/0033 | 248/638 |
| 8,371,827 | B2 * | 2/2013 | Lilie | F04B 35/045 | 417/360 |
| 2003/0017064 | A1 * | 1/2003 | Kawahara | F04B 35/045 | 417/417 |
| 2004/0120834 | A1 * | 6/2004 | Lee | F04B 35/045 | 417/369 |
| 2005/0201875 | A1 * | 9/2005 | Park, II | F04B 35/045 | 417/417 |
| 2009/0202373 | A1 | 8/2009 | Williams et al. | | |

FOREIGN PATENT DOCUMENTS

| | | | | |
|---|---|---|---|---|
| CN | 105275776 | | 1/2016 | |
| EP | 2 975 267 | | 1/2016 | |
| KR | 10-2016-0009306 | * | 1/2016 | F04B 39/12 |
| WO | WO 2005/028870 | | 3/2005 | |

* cited by examiner

LINEAR COMPRESSOR HAVING RADIAL STOPPERS

CROSS-REFERENCE TO RELATED APPLICATION(S)

The present application claims the benefits of priority to Korean Patent Application No. 10-2016-0054910, filed in Korea on May 3, 2016, which is herein incorporated by reference in its entirety.

BACKGROUND

1. Field

A linear compressor is disclosed herein.

2. Background

Cooling systems are systems in which a refrigerant circulates to generate cool air. In such a cooling system, processes of compressing, condensing, expanding, and evaporating the refrigerant are repeatedly performed. The cooling system includes a compressor, a condenser, an expansion device, and an evaporator. Also, the cooling system may be installed or provided in a home appliance including a refrigerator or an air conditioner.

In general, compressors are machines that receive power from a power generation device, such as an electric motor or a turbine, to compress air, a refrigerant, or various gaseous working fluids, thereby increasing a pressure and a temperature. The compressors are being widely used in home appliances or industrial fields.

Such a compressor is largely classified into a reciprocating compressor, a scroll compressor, and a rotary compressor. In recent years, development of a linear compressor belonging to one kind of reciprocating compressor has been actively carried out. The linear compressor may be directly connected to a drive motor, in which a piston is linearly reciprocated, to improve compression efficiency without mechanical loss due to movement conversion and have a simple structure.

In general, the linear compressor suctions a gaseous refrigerant while a piston is moved to linearly reciprocate within a cylinder by a linear motor and then compresses the suctioned refrigerant at a high-temperature and a high-pressure to discharge the compressed refrigerant. A linear compressor and a refrigerator including the same are disclosed in Korean Patent Publication No. 10-2016-0009306, published on Jan. 26, 2016, which is hereby incorporated by reference.

The linear compressor includes a suction part, a discharge part, a compressor casing, a compressor body, and a body support. The body support is configured to support the compressor body within the compressor casing and disposed on each of both ends of the compressor body.

The body support includes a plate spring. The plate spring is mounted in a direction perpendicular to an axial direction of the compressor body. In this case, the plate spring may have high transverse rigidity (rigidity with respect to a direction that extends perpendicular to the axial direction of the compressor body) and low longitudinal rigidity (rigidity with respect to the axial direction of the compressor body).

However, according to the related art document, a lateral stiffness of the plate spring may prevent the motor assembly from colliding with the compressor casing during operation of the compressor, but there may occur a problem that the motor assembly collides with the compressor casing in the process of transferring the compressor or a product equipped with the compressor.

That is, vibration generated during transfer of the compressor is significantly greater than vibration generated during operation of the compressor. Thus, in the process of transferring the compressor, it is highly likely that at least a portion of the motor assembly, the frame contacting the motor assembly, and the stator cover will collide with the compressor casing. As such, when the motor assembly, the frame, or the stator cover collides with the compressor casing, an impact is transferred to the motor assembly, causing damage to the motor assembly.

Also, the compressor body may be spaced apart from each cover when the compressor is in a stopped state, but the compressor body may collide with a cover of any one side due to axial shaking of the compressor body in the process of transferring the compressor. When an impulse of the compressor body and the cover is great, the plate spring may be deformed.

The impulse of the compressor body and the cover increases as an axial movement amount (or a moving distance) of the compressor body increases. In the case of the related art document, as there is no structure for reducing an axial moving distance of the compressor body, it is highly likely that the plate spring will be deformed in the process of transferring the compressor.

BRIEF DESCRIPTION OF THE DRAWINGS

Embodiments will be described in detail with reference to the following drawings in which like reference numerals refer to like elements, and wherein.

DETAILED DESCRIPTION

Figure 1:
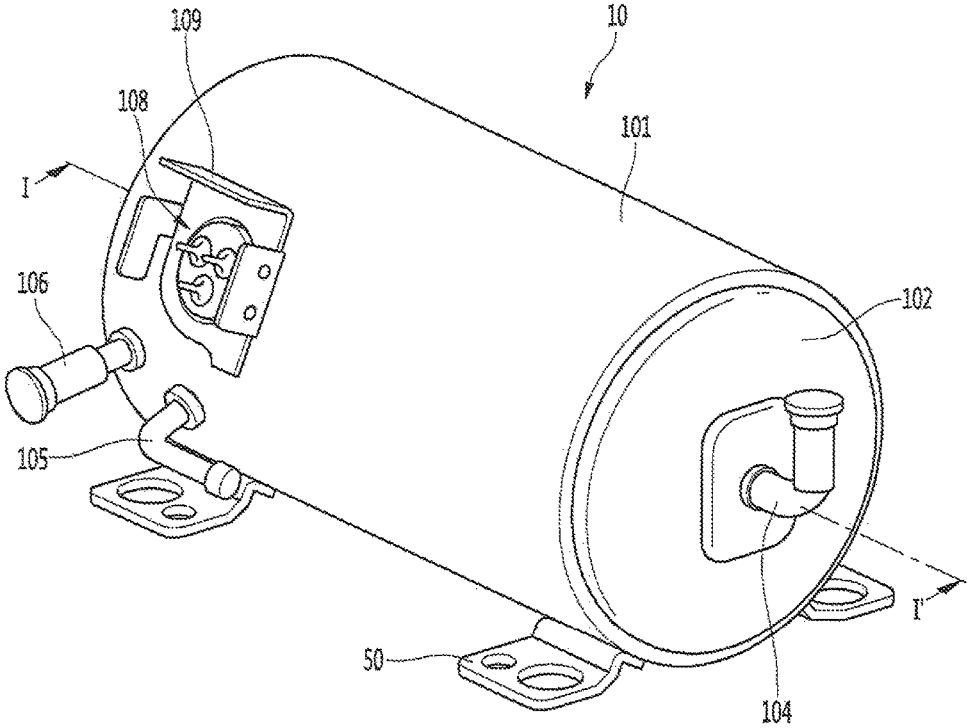
FIG. 1 is a perspective view illustrating an outer appearance of a linear compressor according to an embodiment.

Hereinafter, exemplary embodiments will be described in detail with reference to the accompanying drawings. Where possible, like reference numerals have been used to indicate like elements, and repetitive disclosure has been omitted.

FIG. 1 is a perspective view illustrating an outer appearance of a linear compressor according to an embodiment.

Figure 2:
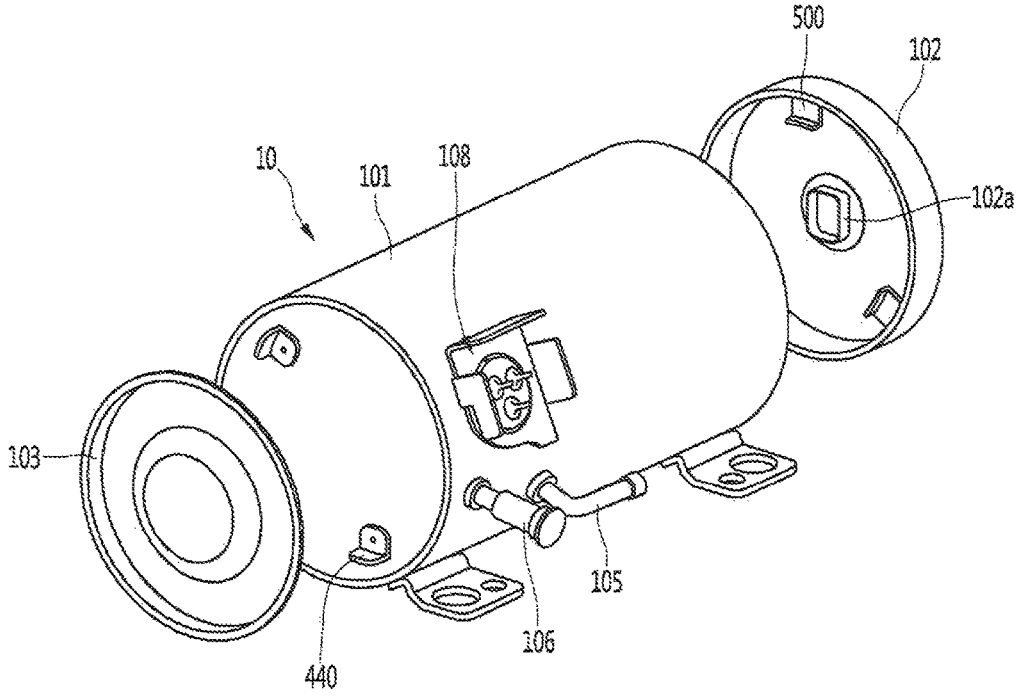
FIG. 2 is an exploded perspective view illustrating a shell and a shell cover of the linear compressor according to an embodiment.

FIG. 2 is an exploded perspective view illustrating a shell and a shell cover of the linear compressor according to an embodiment.

Referring to FIGS. 1 and 2, a linear compressor 10 according to an embodiment may include a shell 101 and shell covers 102 and 103 coupled to the shell 101. In a broad sense, each of the shell covers 102 and 103 may be understood as one component of the shell 101. Therefore, the shell 101 and the shell covers 102 and 103 may be collectively referred to as a compressor casing or a casing.

A leg 50 may be coupled to a lower portion of the shell 101. The leg 50 may be coupled to a base of a product in which the linear compressor 10 is installed or provided. For example, the product may include a refrigerator, and the base may include a machine room base of the refrigerator. For another example, the product may include an outdoor unit of an air conditioner, and the base may include a base of the outdoor unit.

The shell 101 may have an approximately cylindrical shape and be disposed to lie in a horizontal direction or an axial direction. In FIG. 1, the shell 101 may extend in the horizontal direction and have a relatively low height in a radial direction. That is, as the linear compressor 10 has a low height, when the linear compressor 10 is installed or provided in the machine room base of the refrigerator, a machine room may be reduced in height.

A terminal 108 may be installed or provided on an outer surface of the shell 101. The terminal 108 may transmit external power to a motor (see reference numeral 140 of FIG. 3) of the linear compressor 10. The terminal 108 may be connected to a lead line of a coil (see reference numeral 141*c* of FIG. 3).

A bracket 109 may be installed or provided outside of the terminal 108. The bracket 109 may include a plurality of brackets that surrounds the terminal 108. The bracket 109 may protect the terminal 108 against an external impact.

Both sides of the shell 101 may be open. The shell covers 102 and 103 may be coupled to both open sides of the shell 101. The shell covers 102 and 103 may include a first shell cover 102 coupled to one open side of the shell 101 and a second shell cover 103 coupled to the other open side of the shell 101. An inner space of the shell 101 may be sealed by the shell covers 102 and 103.

In FIG. 1, the first shell cover 102 may be disposed at a first or right portion of the linear compressor 10, and the second shell cover 103 may be disposed at a second or left portion of the linear compressor 10. That is, the first and second shell covers 102 and 103 may be disposed to face each other.

The linear compressor 10 further includes a plurality of pipes 104, 105, and 106 provided in the shell 101 or the shell covers 102 and 103 to suction, discharge, or inject the refrigerant. The plurality of pipes 104, 105, and 106 may include a suction pipe 104 through which the refrigerant may be suctioned into the linear compressor 10, a discharge pipe 105 through which the compressed refrigerant may be discharged from the linear compressor 10, and a process pipe through which the refrigerant may be supplemented to the linear compressor 10.

For example, the suction pipe 104 may be coupled to the first shell cover 102. The refrigerant may be suctioned into the linear compressor 10 through the suction pipe 104 in the axial direction.

The discharge pipe 105 may be connected to the shell 101. The refrigerant suctioned through the suction pipe 104 may flow in the axial direction and then be compressed in a compression space, which will be described hereinafter. Also, the compressed refrigerant may be discharged through the discharge pipe 105 to the outside of the compressor 10. The discharge pipe 105 may be disposed at a position which is adjacent to the second shell cover 103 rather than the first shell cover 102.

The process pipe 106 may be coupled to the outer circumferential surface of the shell 101. A worker may inject the refrigerant into the linear compressor 10 through the process pipe 106.

The process pipe 106 may be coupled to the shell 101 at a height different from a height of the discharge pipe 105 to avoid interference with the discharge pipe 105. The height may be understood as a distance from the leg 50 in the vertical direction (or the radial direction). As the discharge pipe 105 and the process pipe 106 are coupled to the outer circumferential surface of the shell 101 at the heights different from each other, a worker's work convenience may be improved.

A first stopper 500 may be disposed or provided on the inner surface of the first shell cover 102. The first stopper 500 may prevent the compressor body 100, particularly, the motor 140 from being damaged by vibration or an impact, which occurs when the linear compressor 10 is carried.

The first stopper 500 may be disposed adjacent to a back cover 170, which will be described hereinafter. When the linear compressor 10 is shaken, the back cover 170 may come into contact with the first stopper 500 to prevent the motor 140 from directly colliding with the shell 101. A fixing bracket 440 will be described with reference to the accompanying drawings.

Figure 3:
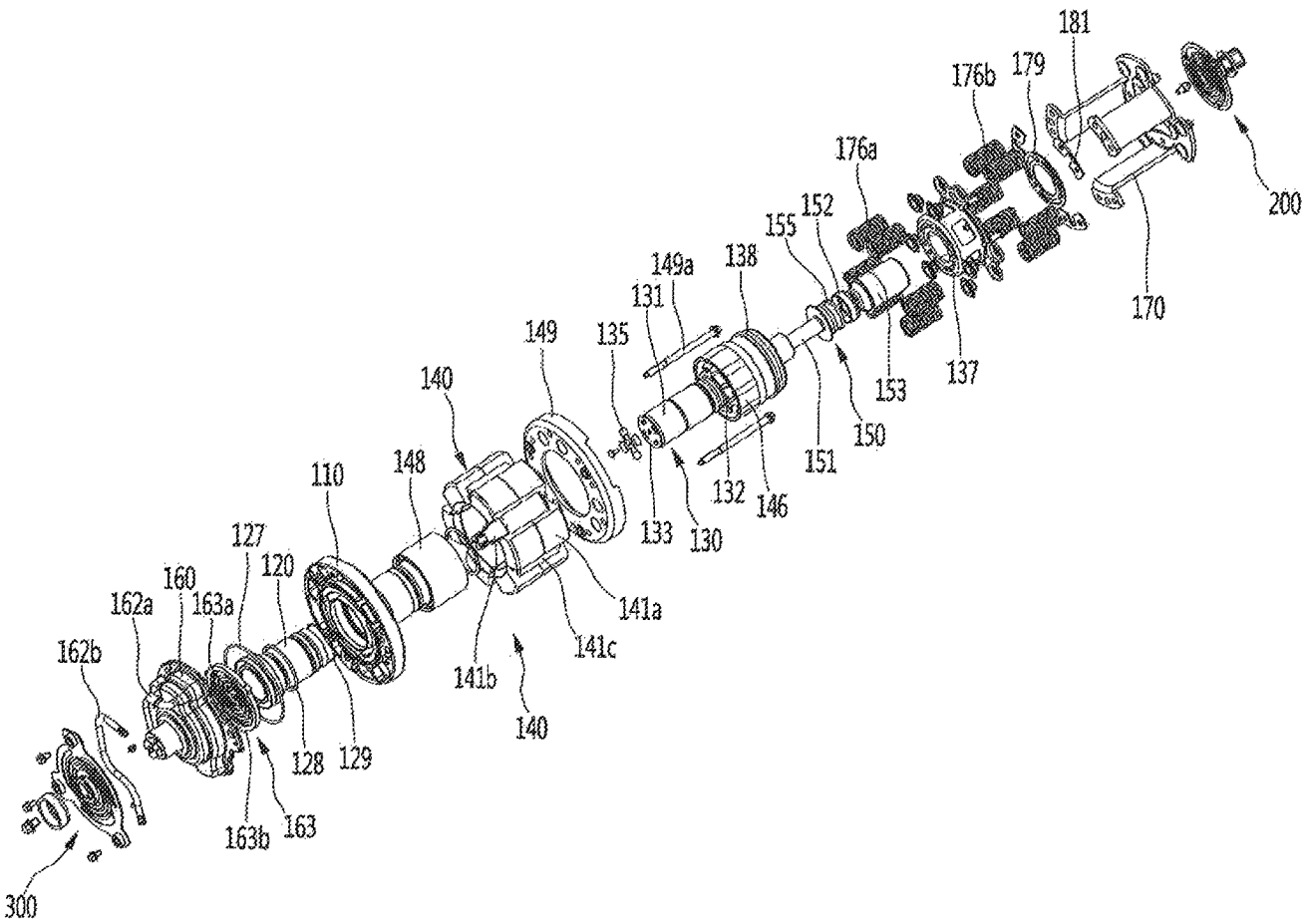
FIG. 3 is an exploded perspective view illustrating internal parts or components of the linear compressor according to an embodiment.
Figure 4:
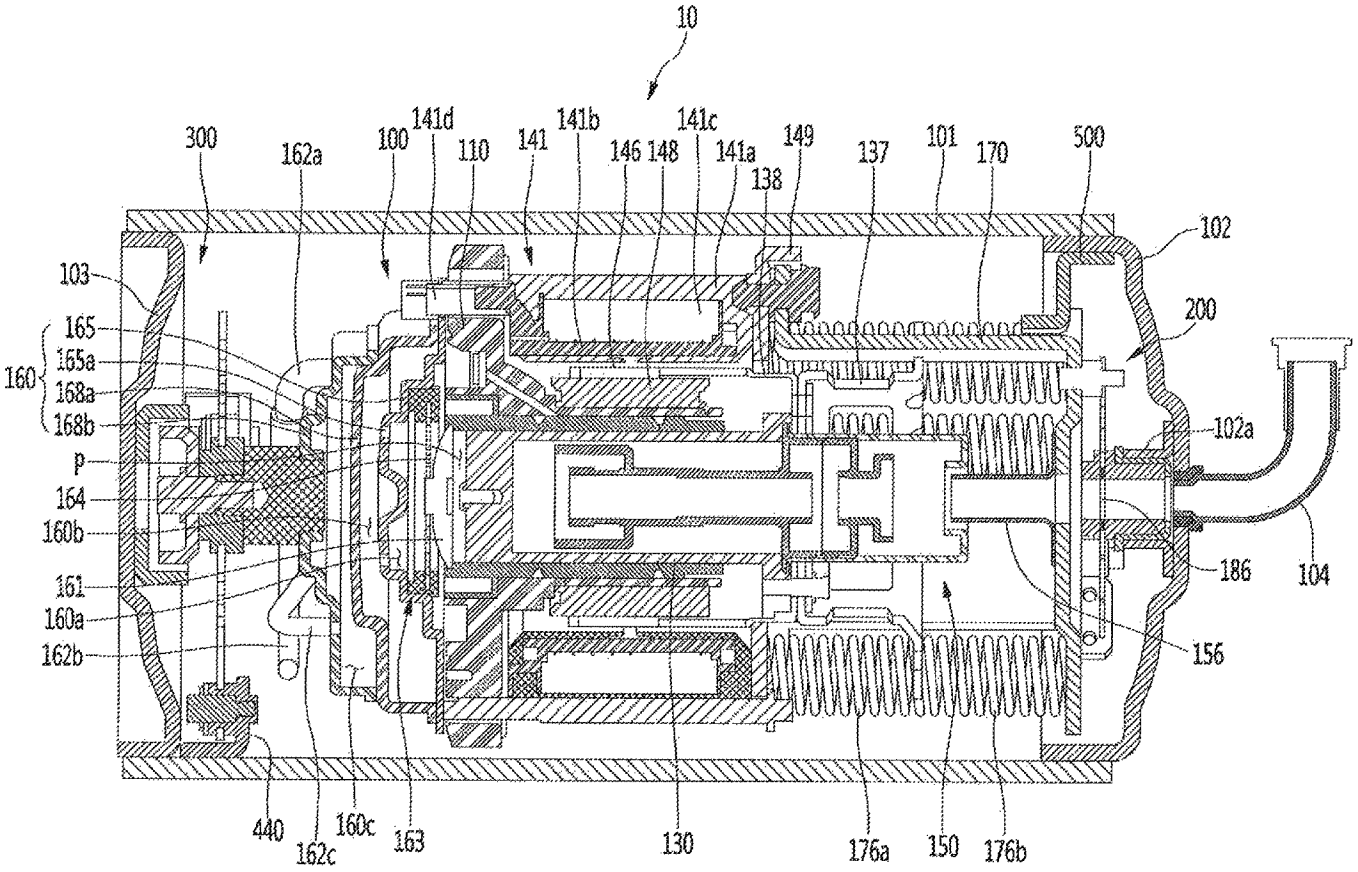
FIG. 4 is a cross-sectional view, taken along line I-I' of FIG. 1.

FIG. 3 is an exploded perspective view illustrating internal parts or components of the linear compressor according to an embodiment. FIG. 4 is a cross-sectional view, taken along line I-I' of FIG. 1.

Referring to FIGS. 3 and 4, the linear compressor 10 according to an embodiment may include the shell 101, a compressor body 100 accommodated in the shell 101, and a plurality of support devices or supports 200 and 300 that supports the compressor body 100. One of the plurality of support devices 200 and 300 may be fixed to the shell 101, and the other one may be fixed to a pair of covers 102 and 103. As a result, the compressor body 100 may be supported to be spaced apart from the inner circumferential surface of the shell 101.

The compressor body 100 may include a cylinder 120 provided in the shell 101, a piston 130 that linearly reciprocates within the cylinder 120, and a motor 140 that applies a drive force to the piston 130. When the motor 140 is driven, the piston 130 may reciprocate in the axial direction.

The compressor body 100 may further include a suction muffler 150 coupled to the piston 130 to reduce noise generated from the refrigerant suctioned through the suction pipe 104. The refrigerant suctioned through the suction pipe 104 may flow into the piston 130 via the suction muffler 150. For example, while the refrigerant passes through the suction muffler 150, a flow noise of the refrigerant may be reduced.

The suction muffler 150 may include a plurality of mufflers 151, 152, and 153. The plurality of mufflers 151, 152, and 153 may include a first muffler 151, a second muffler 152, and a third muffler 153, which may be coupled to each other.

The first muffler 151 may be disposed or provided within the piston 130, and the second muffler 152 may be coupled to a rear portion of the first muffler 151. Also, the third muffler 153 may accommodate the second muffler 152 therein and extend to a rear side of the first muffler 151. In view of a flow direction of the refrigerant, the refrigerant suctioned through the suction pipe 104 may successively pass through the third muffler 153, the second muffler 152, and the first muffler 151. In this process, a flow noise of the refrigerant may be reduced.

The suction muffler 150 may further include a muffler filter 155. The muffler filter 155 may be disposed on or at an interface on or at which the first muffler 151 and the second muffler 152 are coupled to each other. For example, the muffler filter 155 may have a circular shape, and an outer circumferential portion of the muffler filter 155 may be supported between the first and second mufflers 151 and 152.

The "axial direction" may be understood as a direction in which the piston 130 reciprocates, that is, a horizontal direction in FIG. 4. Also, "in the axial direction", a direction from the suction pipe 104 toward a compression space P, that is, a direction in which the refrigerant flows may be defined as a "frontward direction", and a direction opposite to the frontward direction may be defined as a "rearward direction". On the other hand, the "radial direction" may be understood as a direction which is perpendicular to the direction in which the piston 130 reciprocates, that is, a vertical direction in FIG. 4. The "axis of the compressor body" may represent a central line or central longitude axis in the axial direction of the piston 130.

The piston 130 may include a piston body 131 having an approximately cylindrical shape and a piston flange part or flange 132 that extends from the piston body 131 in the radial direction. The piston body 131 may reciprocate inside of the cylinder 120, and the piston flange part 132 may reciprocate outside of the cylinder 120.

The cylinder 120 may be configured to accommodate at least a portion of the first muffler 151 and at least a portion of the piston body 131. The cylinder 120 may have the compression space P in which the refrigerant may be compressed by the piston 130. Also, a suction hole 133, through which the refrigerant may be introduced into the compression space P, may be defined in a front portion of the piston body 131, and a suction valve 135 that selectively opens the suction hole 133 may be disposed or provided on a front side of the suction hole 133. A coupling hole, to which a predetermined coupling member 135*a* may be coupled, may be defined in an approximately central portion of the suction valve 135.

A discharge cover 160 that defines a plurality of discharge spaces for the refrigerant discharged from the compression space P and a discharge valve assembly 161 and 163 coupled to the discharge cover assembly 160 to selectively discharge the refrigerant compressed in the compression space P may be provided at a front side of the compression space P. The discharge cover assembly 160 may include a discharge cover 165 coupled to a front surface of the cylinder 120 to accommodate the discharge valve assembly 161 and 163 therein and a plurality of discharge mufflers coupled to a front surface of the discharge cover 165. The plurality of discharge mufflers may include a first discharge muffler 168*a* coupled to the front surface of the discharge cover 165 and a second discharge muffler 168*b* coupled to a front surface of the first discharge muffler 168*a*; however, the number of discharge mufflers are not limited thereto.

The plurality of discharge spaces may include a first discharge space 160*a* defined inside of the discharge cover 165, a second discharge space 160*b* defined between the discharge cover 165 and the first discharge muffler 168*a*, and a third discharge space 160*c* defined between the first discharge muffler 168*a* and the second discharge muffler 168*b*. The discharge valve assembly 161 and 163 may be accommodated in the first discharge space 160*a*.

One or a plurality of discharge holes 165*a* may be defined in the discharge cover 165, and the refrigerant discharged into the first discharge space 160*a* may be discharged into the second discharge space 160*b* through the discharge hole 165*a* and thus is reduced in discharge noise.

The discharge valve assembly 161 and 163 may include a discharge valve 161, which may be opened when a pressure of the compression space P is above a discharge pressure to introduce the refrigerant into the discharge space of the discharge cover assembly 160 and a spring assembly 163 fixed to the inside of the discharge cover 165 to provide elastic force in the axial direction to the discharge valve 161. The spring assembly 163 may include a valve spring 163*a* that applies elastic force to the discharge valve 161 and a spring support part or support 163*b* that supports the valve spring 163*a* to the discharge cover 165.

For example, the valve spring 163*a* may include a plate spring. Also, the spring support part 163*b* may be integrally injection-molded to the valve spring 163*a* through an insertion-molding process, for example.

The discharge valve 161 may be coupled to the valve spring 163*a*, and a rear portion or a rear surface of the discharge valve 161 may be disposed to be supported on the front surface of the cylinder 120. When the discharge valve 161 is closely attached to the front surface of the cylinder 120, the compression space P may be maintained in a sealed state. When the discharge valve 161 is spaced apart from the front surface of the cylinder 120, the compression space P may be opened to discharge the refrigerant compressed in the compression space P to the first discharge space 160*a*.

The compression space P may be a space defined between the suction valve 135 and the discharge valve 161. Also, the suction valve 135 may be disposed on or at one side of the compression space P, and the discharge valve 161 may be disposed on or at the other side of the compression space P, that is, an opposite side of the suction valve 135.

While the piston 130 linearly reciprocates within the cylinder 120, when a pressure of the compression space P is less than a pressure inside of the suction muffler 150, the suction valve 135 may be opened, and the refrigerant introduced into the suction muffler 150 suctioned into the compression space P. Also, when the refrigerant increases in flow rate, and thus, the pressure of the compression space P is greater than the pressure inside of the suction muffler 150, the suction valve 135 may be closed to become a state in which the refrigerant is compressible.

When the pressure of the compression space P is greater than the pressure of the first discharge space 106*a*, the valve spring 163*a* may be elastically deformed forward to allow the discharge valve 161 to be spaced apart from the front surface of the cylinder 120. Also, when the discharge valve 161 is opened, the refrigerant may be discharged from the compression space P to the first discharge space 160*a*. When the pressure of the compression space P is less than the pressure of the first discharge space 160*a* by the discharge of the refrigerant, the valve spring 163*a* may provide a restoring force to the discharge valve 161 to allow the discharge valve 161 to be closed.

The compressor body 100 may further include a connection pipe 162*c* that connects the second discharge space 160*b* to the third discharge space 160*c*, a cover pipe 162*a* connected to the second discharge muffler 168*b*, and a loop pipe 162*b* that connects the cover pipe 162*a* to the discharge pipe 105. The connection pipe 162*c* may have one or a first end that passes through the first discharge muffler 168*a* and inserted into the second discharge space 160*b* and the other or a second end connected to the second discharge muffler 158*b* to communicate with the third discharge space 160*c*. Thus, the refrigerant discharged to the second discharge space 160*b* may be further reduced in noise while moving to the third discharge space 160*c* along the connection pipe 162*c*. Each of the pipes 162*a*, 162*b*, and 162*c* may be made of a metal material, for example.

The loop pipe 162*b* may have one or a first side or end coupled to the cover pipe 162*a* and the other or a second side or end coupled to the discharge pipe 105. The loop pipe 162*b* may be made of a flexible material. Also, the loop pipe 162*b* may roundly extend from the cover pipe 162*a* along the inner circumferential surface of the shell 101 and be coupled to the discharge pipe 105. For example, the loop pipe 162*b* may be provided in a wound shape. While the refrigerant flows along the loop pipe 162*b*, noise may be further reduced.

The compressor body 100 may further include a frame 110. The frame 110 may be a part that fixes the cylinder 120. For example, the cylinder 120 may be press-fitted into the frame 110.

The frame 110 may be disposed or provided to surround the cylinder 120. That is, the cylinder 120 may be inserted into an accommodation groove defined in the frame 110. Also, the discharge cover assembly 160 may be coupled to a front surface of the frame 110 by using a coupling member.

The compressor body 100 may further include the motor 140. The motor 140 may include an outer stator 141 fixed to the frame 110 to surround the cylinder 120, an inner stator 148 disposed or provided to be spaced Inward from the outer stator 141, and a permanent magnet 146 disposed or provided in a space between the outer stator 141 and the inner stator 148.

The permanent magnet 146 may be linearly reciprocated by mutual electromagnetic force between the outer stator 141 and the inner stator 148. Also, the permanent magnet 146 may be provided as a single magnet having one polarity or by coupling a plurality of magnets having three polarities to each other.

The permanent magnet 146 may be disposed or provided on the magnet frame 138. The magnet frame 138 may have an approximately cylindrical shape and be disposed or provided to be inserted into the space between the outer stator 141 and the inner stator 148.

Referring to the cross-sectional view of FIG. 4, the magnet frame 138 may be bent forward after extending from the outer circumferential surface of the piston flange part or flange 132 in the radial direction. The permanent magnet 146 may be fixed to a front end of the magnet frame 138. Thus, when the permanent magnet 146 reciprocates, the piston 130 may reciprocate together with the permanent magnet 146 in the axial direction.

The outer stator 141 may include coil winding bodies 141*b*, 141*c*, and 141*d*, and a stator core 141*a*. The coil winding bodies 141*b*, 141*c*, and 141*d* may include a bobbin 141*b* and a coil 141*c* wound in a circumferential direction of the bobbin 141*b*. The coil winding bodies 141*b*, 141*c*, and 141*d* may further include a terminal part or portion 141*d* that guides a power line connected to the coil 141*c* so that the power line is led out or exposed to the outside of the outer stator 141.

The stator core 141*a* may include a plurality of core blocks in which a plurality of laminations may be laminated in a circumferential direction. The plurality of core blocks may be disposed or provided to surround at least a portion of the coil winding bodies 141*b* and 141*c*.

A stator cover 149 may be disposed on one or a first side of the outer stator 141. That is, the outer stator 141 may have one or a first side supported by the frame 110 and the other or a second side supported by the stator cover 149.

The linear compressor 10 may further include a cover coupling member 149*a* that couples the stator cover 149 to the frame 110. The cover coupling member 149*a* may pass through the stator cover 149 to extend forward to the frame 110 and then be coupled to the frame 110.

That is, the cover coupling member 149*a* may be coupled to the stator cover 149 and the frame 110 in a state in which one or a first side of the motor is supported to or by the frame 110 and the other or a second side of the motor is supported to the stator cover 149. Therefore, the motor 140, and the frame 110 and the stator cover 149 supporting the motor 140 may be collectively referred to as a "motor assembly".

Also, as the frame 110 and the stator cover 149 are components supporting the motor 140, the frame 110 and the stator cover 149 may be referred to as a "motor support part" or "motor support".

The inner stator 148 may be fixed to an outer circumference of the frame 110. Also, in the inner stator 148, the plurality of laminations may be laminated outside of the frame 110 in the circumferential direction.

The compressor body 100 may further include a support 137 that supports the piston 130. The support 137 may be coupled to a rear portion of the piston 130, and the muffler 150 may be disposed or provided to pass through the inside of the support 137. The piston flange part 132, the magnet frame 138, and the support 137 may be coupled to each other using a coupling member.

A balance weight 179 may be coupled to the support 137. A weight of the balance weight 179 may be determined based on a drive frequency range of the compressor body 100.

The compressor body 100 may further include a back cover 170 coupled to the stator cover 149 to extend backward. The back cover 170 may include three support legs, however, embodiments are not limited thereto, and the three support legs may be coupled to a rear surface of the stator cover 149. A spacer 181 may be disposed or provided between the three support legs and the rear surface of the stator cover 149. A distance from the stator cover 149 to a rear end of the back cover 170 may be determined by adjusting a thickness of the spacer 181. The back cover 170 may be spring-supported by the support 137.

The compressor body 100 may further include an inflow guide part or guide 156 coupled to the back cover 170 to guide an inflow of the refrigerant into the muffler 150. At least a portion of the inflow guide part 156 may be inserted into the suction muffler 150.

The compressor body 100 may further include a plurality of resonant springs 176*a* and 176*b* which may be adjusted in natural frequency to allow the piston 130 to perform a resonant motion. The plurality of resonant springs 176*a* and 176*b* may include a first resonant spring 176*a* supported between the support 137 and the stator cover 149 and a second resonant spring 176*b* supported between the support 137 and the back cover 170. The piston 130 that reciprocates within the linear compressor 10 may be stably moved by the action of the plurality of resonant springs 176*a* and 176*b* to reduce vibration or noise due to the movement of the piston 130.

The compressor body 100 may further include a plurality of sealing members or seals 127 and 128 that increases a coupling force between the frame 110 and the peripheral parts or portions around the frame 110. The plurality of sealing members 127 and 128 may include a first sealing member or seal 127 disposed or provided at a portion at which the frame 110 and the discharge cover 165 are coupled to each other. The plurality of sealing members 127 and 128 may further include a second sealing member or seal 128 disposed or provided at a portion at which the frame 110 and the cylinder 120 are coupled to each other. Each of the first and second sealing members 127 and 128 may have a ring shape.

The plurality of support devices 200 and 300 may include a first support device or support 200 coupled to one or a first side of the compressor body 100 and a second support device or support 300 coupled to the other or a second side of the compressor body 100. The first support device 200 may be fixed to the first shell cover 102, and the second support device 300 may be fixed to the shell 101. As axial vibration and radial vibration of the compressor body 100 may be absorbed by the plurality of support devices 200 and 300, it is possible to prevent the compressor body 100 from directly colliding with the shell 101 or the shell covers 102 and 103.

Figure 5:
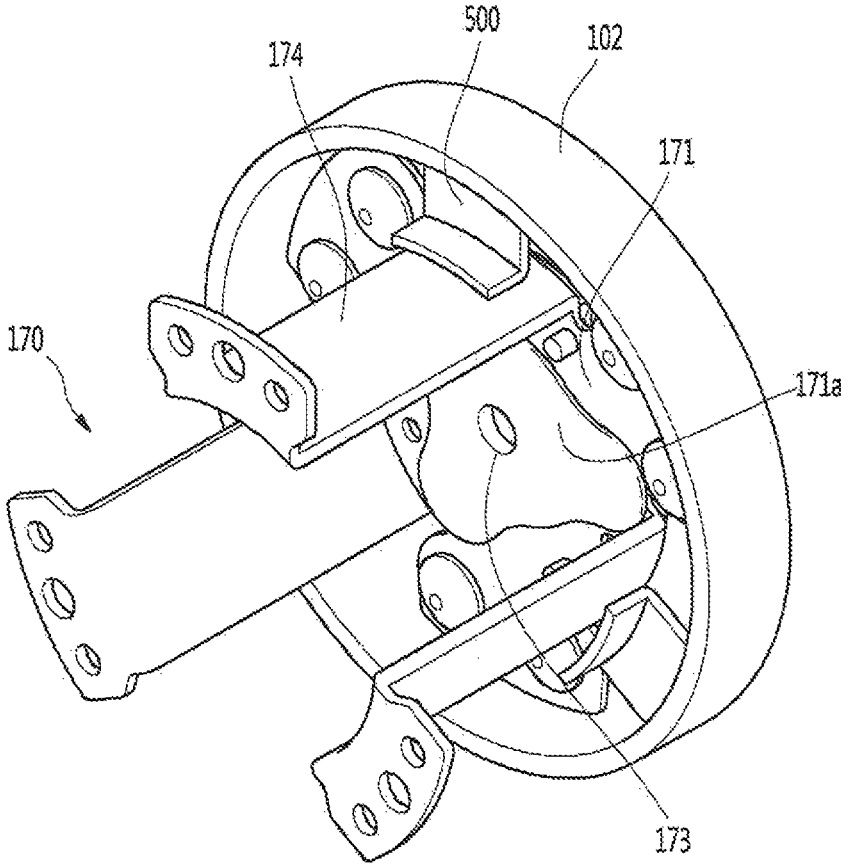
FIG. 5 is a perspective view illustrating a state in which a back cover is fixed to a first shell cover by a first support device or support.
Figure 6:
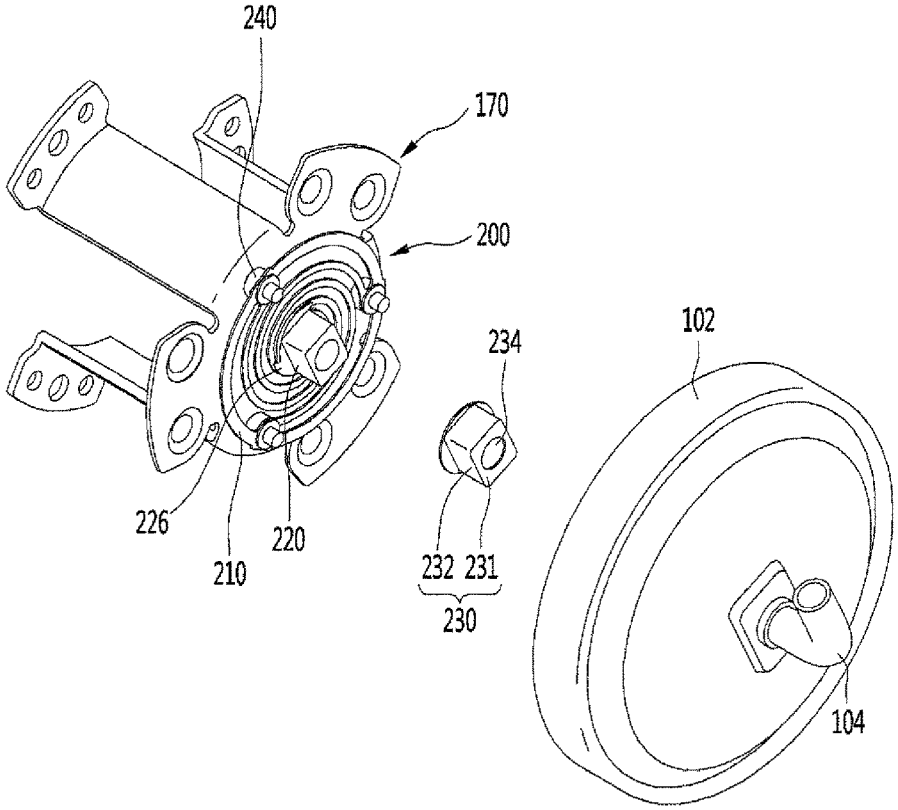
FIGS. 6 and 7 are perspective views illustrating the first support device and the first shell cover according to an embodiment.
Figure 7:
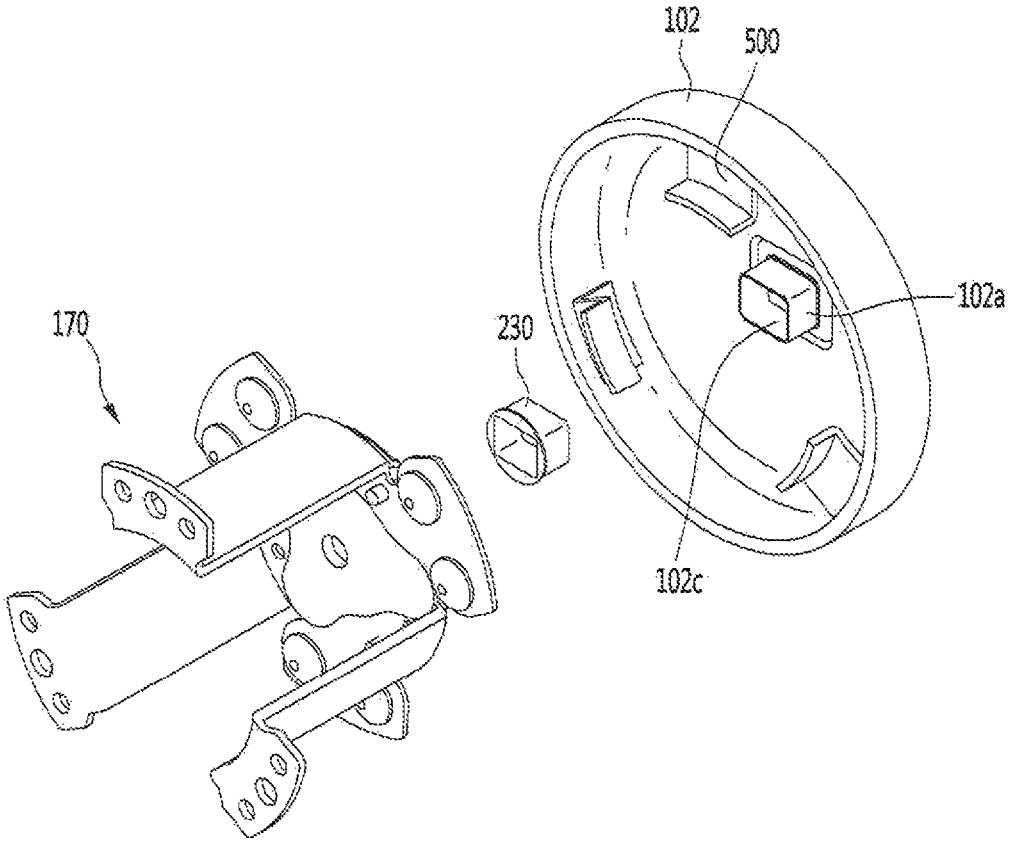
Figure 8:
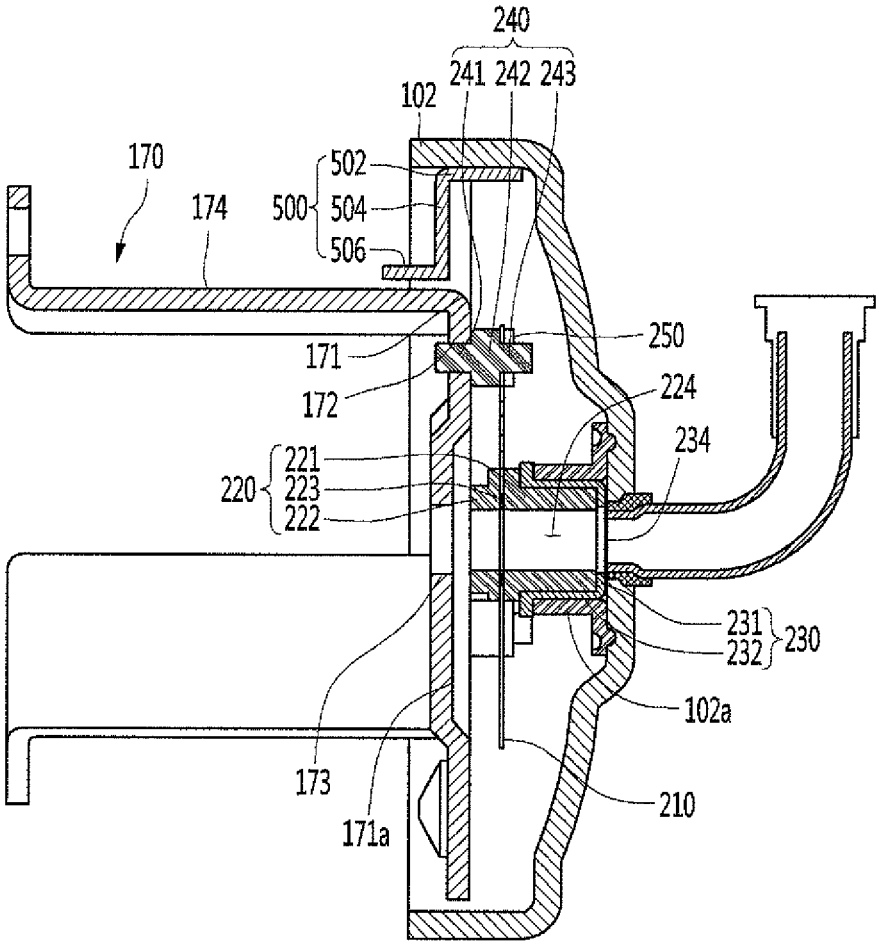
FIG. 8 is a cross-sectional view showing a state in which the first support device is coupled to the first shell cover.
Figure 9:
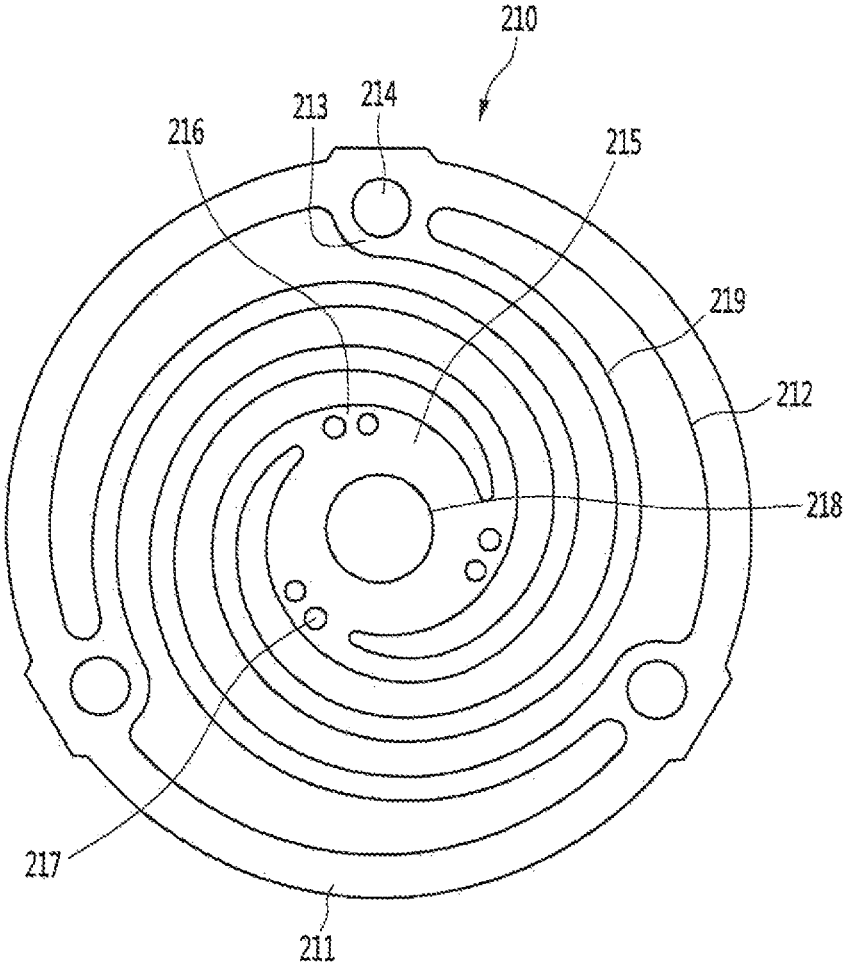
FIG. 9 is a plan view of a first plate spring.

FIG. 5 is a perspective view illustrating a state in which a back cover is fixed to a first shell cover by a first support device or support. FIGS. 6 and 7 are perspective views illustrating the first support device and the first shell cover according to an embodiment. FIG. 8 is a cross-sectional view showing a state in which the first support device is coupled to the first shell cover. FIG. 9 is a plan view of the first plate spring.

Referring to FIGS. 5 to 9, the first support device 200 may be coupled to one of the first shell cover 102 or the second shell cover 103 in a state of being coupled to one side of the compressor body 100. The first support device 200 may be coupled to one of the first shell cover 102 or the second shell cover 103 in a state of being spaced apart from an inner circumferential surface of the shell 101. For example, FIG. 7 illustrates a state in which the first support device 200 is coupled to the first shell cover 102.

Although not limited thereto, the first support device 200 may be disposed or provided at a central portion of the first shell cover 102. In this case, an axis or central longitudinal axis of the compressor body 100 may pass through the central portion of the first shell cover 102, and thus, vibration of the compressor body 100 in the radial direction may be minimized while the compressor body 100 operates.

The first support device 200 may include a first plate spring 210. When the first support device 200 is coupled to the first shell cover 102, the first plate spring 210 may be fixed to the back cover 170.

The first plate spring 210 may be disposed or provided to stand up within the shell 101 so that the axis of the compressor body 100 passes through a center of the first plate spring 210.

When the first support device 200 includes the first plate spring 210, the first support device 200 may be reduced in size. In addition, vibration of the compressor body 100 may be effectively absorbed, and also, collision between the compressor body 100 and the shell 101 may be prevented by a large transverse stiffness (stiffness in a direction perpendicular to an axial direction of the compressor body) and a small longitudinal stiffness (stiffness in the axial direction of the compressor body), which correspond to characteristics of the first plate spring 210.

The first support device 200 may further include a first spring connection part or portion 220 connected to the first plate spring 210. The first spring connection part 220 may allow the first support device 200 to be easily coupled to the first shell cover 102.

A cover support part or portion 102*a* that couples the first support device 200 may be provided on the first shell cover 102. The cover support part 102*a* may be integrated with the first shell cover 102 or coupled to the first shell cover 102.

The first spring connection part 220 may be inserted into an accommodation part or portion 102*c* of the cover support part 102*a*. A buffer part or buffer 230 may be disposed or provided between the first spring connection part 220 and the cover support part 102*a*. Thus, vibration transmitted from the first spring connection part 220 may not be transmitted to the cover support part 102*a*, but be absorbed by the buffer part 230. The buffer part 230 may be made of a rubber material or a material which is capable of absorbing an impact while being deformed by an external force.

Although is not limited thereto, the buffer part 230 may be fitted into the cover support part 102*a*, and the first spring connection part 220 may be fitted into the buffer part 230. Each of the accommodation part 102*c* of the cover support part 102*a* and the buffer part 230 may have a non-circular cross-section so that the buffer part 230 does not relatively rotate with respect to the cover support part 102*a*. Also, a portion of the first spring connection part 220, which is inserted into the buffer part 230, may have a non-circular cross-section so that the first spring connection part 220 does not relatively rotate with respect to the buffer part 230.

The buffer part 230 may include a first contact surface 231 that comes into contact with or contacts the first spring connection part 220 in the axial direction to absorb the vibration transmitted from the first support device 200 in the axial direction and a second contact surface 232 that comes into contact with or contacts the first spring connection part 220 in the radial direction to absorb vibration transmitted from the first support device 200 in the radial direction. The second contact surface 232 may have a shape which surrounds at least a portion of the first spring connection part 220. An opening 234 through which the refrigerant may pass may be defined in the first contact surface 231.

According to this embodiment, the first support device 200 may be coupled to the first shell cover 102. As the buffer part 230 may be disposed or provided between the first support device 200 and the first shell cover 102, transmission of vibration, which is generated while the compressor body 100 operates, into the shell 101 through the first shell cover 102 may be minimized.

In a case of this embodiment, vibration of the compressor body 100 in the axial direction may be absorbed by the first plate spring 210, and vibration of the compressor body 100 in the radial direction may be absorbed by the buffer part 230. Thus, transmission of vibration of the compressor body 100 into the shell 101 through the first shell cover 102 may be effectively reduced.

A refrigerant passage 224 through which the refrigerant suctioned through the suction pipe 104 may pass may be defined in the central portion of the first spring connection part 220. For example, in a state in which the first spring connection part 220 is fitted into the buffer part 230, the refrigerant passage 224 may be aligned with the opening 234 of the buffer part 230.

The first plate spring 210 may include an outer rim 211, an inner rim 215, and a plurality of connection parts or portions 219 having a spirally rounded shape and connecting the outer rim 211 to the inner rim 215. More particularly, the plurality of connection parts 219 may be formed by a plurality of spiral holes defined inside of the metal plate having an approximately circular shape.

A plurality of rounded extension parts or extensions 216 may be spaced apart from the inner rim 215 in the circumferential direction on an outer edge of the inner rim 215. The plurality of connection parts 219 may be connected to the plurality of rounded extension parts 216, respectively.

A through-hole through which the first spring connection part 220 may pass may be defined in a center of the metal plate having the approximately circular shape. A hole or slit extending in a spiral shape from an outer edge to an inner edge of the metal plate may be defined. A plurality of the hole or slit may be provided to form the first plate spring 210 having a predetermined elasticity.

That is, an outermost edge of the plurality of holes or slits extending in the spiral shape may be located at a point which is spaced a predetermined distance from an outer edge of the metal plate in the circumferential direction. An innermost edge of the plurality of holes or slits may be located at a point which is spaced a predetermined distance from an inner edge of the metal plate in the circumferential direction. A boundary between the plurality of holes or slits may be defined as the connection part 219.

The first spring connection part 220 may be integrally formed with the inner rim 215 by insert injection molding, for example. The first spring connection part 220 may include a first portion that comes into contact with or contacts a first surface of the inner rim 215, a second portion 222 that comes into contact with or contacts a second surface which is opposite to the first surface, and a third portion 223 that passes through the through-hole 218 defined inside of the inner rim 215 to connect the first portion 221 to the second portion 222 to prevent the first spring connection part 220 from being separated in the axial direction of the compressor body 100 in a state in which the first spring connection part 220 is insert-injection-molded to the inner rim 215. The third portion 223 may pass through the through-hole 218, and the first and second portions 221 and 222 may extend from an outer circumferential surface of the first portion 223 in the radial direction. Also, the first portion 221 and the second portion 222 may be spaced a distance corresponding to a thickness of the first plate spring 210 from each other.

Thus, each of the first and second portions 221 and 222 may have a diameter greater than a diameter of the through-hole 218 of the inner rim 215. That is, each of the first and second portions 221 and 222 may have a diameter greater than a diameter of the third portion 223. When the first spring connection part 220 is completely inserted into the buffer part 230, a rear end of the third portion 223 may come into contact with or contact the first contact surface 231 of the buffer part 230.

At least one hole 217 may be defined in the extension part 216 so that the first spring connection part 220 does not relatively rotate with respect to the first plate spring 210 in a state in which the first spring connection part 220 is inset injection-molded to the first plate spring 210. A plurality of the hole 217 may be provided spaced apart from each other in the circumferential direction of the inner rim 215. The plurality of holes 217 may be defined in positions which are spaced apart from the through-hole 218 of the inner rim 215 in the radial direction.

While the first spring connection part 220 is insert-injection-molded to the first plate spring 210, a resin solution for forming the first spring connection part 220 may be filled into the plurality of holes 217. Thus, after the first spring connection part 220 is insert-injection-molded to the first plate spring 210, the resin solution filled into the plurality of holes 217 may be cured to act as rotation resistance, thereby preventing the first spring connection part 220 from relatively rotating with respect to the first plate spring 210.

If the first plate spring 210 and the first spring connection part 220 relatively rotate with respect to each other in a state in which the first plate spring 210 is fixed to the compressor body 100, and the first spring connection part 220 is fixed to the first shell cover 102, the compressor body 100 may rotate around the axis while the compressor body 100 operates to increase vibration of the compressor body 100 in the radial direction and/or the circumferential direction. However, according to this embodiment, as the relative rotation between the plate spring 210 and the spring connection part 220 is prevented, vibration of the compressor body 100 in the radial direction and/or the circumferential direction while the compressor body 100 operates may be reduced.

The first spring connection part 220 may further include a rounded extension part or extension 226 having a same shape as each of the rounded extension parts 216 of the inner rim 215. The extension part 226 may be disposed or provided in a same shape on front and rear surfaces of the first plate spring 210, and then, the front extension part and the rear extension part may be connected by the resin solution filled into the plurality of holes 217.

A plurality of internal extension parts or extensions 213 may be disposed or provided on an inner circumferential surface 212 of the outer rim 211. The plurality of internal extension parts 213 may be disposed or provided to be spaced apart from each other in the circumferential direction of the outer rim 211, and the plurality of connection parts 219 may be respectively connected to the plurality of internal extension parts 213.

In this embodiment, each of the internal extension parts 213 is connected to each of the connection parts 219, a possibility of damage of a connection point between the outer rim 211 and the connection part 219 due to vibration in the axial direction may be reduced. Also, a coupling hole 214 may be defined in each of the plurality of internal extension parts 213, and a back cover coupling member 240 that couples the first plate spring 210 to the back cover 170 may pass through the coupling hole 214.

The back cover coupling member 240 may include a cover insertion part or portion 241 that passes through the coupling hole 172 of the back cover 170, a contact part or contact 242 that comes into contact with or contacts the back cover 170, and a spring insertion part or portion 243 that passes through the coupling hole 214 of the first plate spring 210.

The contact part 242 may have a diameter greater than a diameter of each of the cover insertion part 241 and the spring insertion part 243. Thus, when the cover insertion part 241 is inserted into the coupling hole 172 of the back cover 170 to allow the contact part 242 to be closely attached to the back cover 170, the first plate spring 210 and the back cover 170 may be spaced a length of the contact part 242 from each other. A washer 250 may be coupled to the spring insertion part 243 to prevent the first plate spring 210 from being separated from the back cover coupling member 240 in a state in which the spring insertion part 233 passes through the coupling hole 214 of the first plate spring 210.

The back cover 170 may include a cover body 171 that defines the coupling hole 172, and a plurality of coupling legs 174 that extends from the cover body 171 toward the motor 140. Each of the plurality of coupling legs 174 may be coupled to a rear surface of the stator cover 149. A number of the plurality of first stoppers 500 may be equal to a number of coupling legs 174.

The plurality of first stoppers 500 may extend from the inner circumferential surface of the first shell cover 102 toward the axis of the compressor body 100. The plurality of first stoppers 500 may be spaced apart from the inner circumferential surface of the first shell cover 102 in the circumferential direction. Also, the plurality of coupling legs 174 may be spaced apart in the circumferential direction of the cover body 171.

The plurality of first stoppers 500 may include a fixing part or portion 502 fixed to the inner circumferential surface of the first shell cover 102, an extension part or extension 504 bent at the fixing part 502 in the radial direction of the compressor body 100, and a contact part or contact 506 bent at an end of the extension part 504 and extending in parallel to the axis of the compressor body 100. The fixing part 502 may be fixed to the inner circumferential surface of the first shell cover 102 by welding, for example; however, embodiments are not limited to a method of fixing the fixing part 502.

Also, in order to prevent the fixing part 502 from being separated from the first shell cover 102 while the back cover 170 collides with the first stopper 500, in a state in which the fixing part 502 is fixed to the inner circumferential surface of the first shell cover 102, a length of the fixing part 502 extending in parallel to the axis of the compressor body 100 may be about ½ or more of a length of the first shell cover 102 extending in parallel to the axis of the compressor body 100. The fixing part 502 and the contact part 506 may extend in opposite directions with respect to the extension part 504.

In a state in which the compressor body 100 is coupled to the first shell cover 102 by the first support device 200, the plurality of coupling legs 174 may be respectively disposed to face the plurality of first stoppers 500. The plurality of coupling legs 174 may be respectively spaced apart from the plurality of first stoppers 500.

When the compressor body 100 is not operated, an interval between the shell 101 and the motor 140 is greater than an interval between the frame 110 and the shell 101 and an interval between the stator cover 149 and the shell 101. Therefore, according to embodiments, the motor 140 does not directly collide with the shell 101 even when the compressor body 100 vibrates in the radial direction.

However, the frame 110 and the stator cover 149 directly contact and support the motor 140. Therefore, if one or more of the frame 110 and the stator cover 149 collides with the shell 101, an impact is transferred to the motor 140, and thus, it is highly likely that the motor 140 will be damaged. According to embodiments, in order to prevent the frame 110 and the stator cover 149 from colliding with the shell 101 when the compressor body 100 vibrates in the radial direction, an interval between each of the plurality of coupling legs 174 and each of the plurality of first stoppers 500 may be less than an interval between the frame 110 and the shell 101 and an interval between the stator cover 149 and the shell 101, in a state in which the compressor body 100 is not operated. In other words, the interval between each of the plurality of coupling legs 174 and the contact part 506 of each of the plurality of first stoppers 500 may be less than a minimum interval between the motor assembly and the shell 101.

Therefore, even when the compressor body 100 vibrates in the radial direction in a process of transferring the linear compressor 10, one or more of the plurality of coupling legs 174 may contact one or more of the plurality of first stoppers 500, thereby limiting a vibration width (or vibration displacement). Consequently, it is possible to prevent the frame 110 and the stator cover 149 from colliding with the shell 101, thereby preventing damage to the motor 140.

The back cover 170 and the plurality of first stoppers 500 may be made of a metal material so as to prevent the back cover 170 and the plurality of stoppers 500 from being deformed by collision of the plurality of coupling legs 174 and the plurality of first stoppers 500. Also, the back cover 170 may be coupled to the stator cover 149, and the contact part 506 of each of the plurality of first stoppers 500 may contact a region adjacent to the cover body 171 at each of the plurality of coupling legs 174, so as to minimize transfer of an impact to the stator cover 149 due to an impact caused by collision of one or more of the plurality of coupling legs 174 and one or more of the plurality of first stoppers 500.

For example, due to vibration, the contact part 506 of each of the plurality of first stoppers 500 may contact a region between a line bisecting the plurality of coupling legs 174 in the axial direction and the cover body 171. According to embodiments, as the plurality of first stoppers 500 are spaced apart in the circumferential direction of the first shell cover 102, it is possible to effectively prevent the frame 110 and the stator cover 149 from colliding with the shell 101, regardless of a vibrating direction of the compressor body 100.

Also, as the plurality of first stoppers 500 are disposed in the first shell cover 102, it is possible to prevent the plurality of coupling legs 174 from colliding with the shell 101, and thus, it is possible to prevent noise from being generated by the collision. The plurality of first stoppers 500 may be formed in the shell 101.

Also, according to embodiments, as the contact part 506 extends from the extension part 504 in a direction parallel to the axis of the compressor body 100, one or more of the plurality of coupling legs 174 come into surface contact with or contacts one or more of the plurality of first stoppers 500 due to the radial vibration of the compressor body 100. As a result, the plurality of coupling legs 174 may be rapidly aligned in the horizontal shape.

On the other hand, a recess part or recess 171*a* may be formed in the cover body 171. The recess part 171*a* may be recessed from the cover body 171 toward the motor 140. Therefore, as illustrated in FIG. 8, the spring coupling part 220 may maintain a state of being spaced apart from the recess part 171*a* when the compressor body 100 is not operated.

When the compressor body 100 moves toward the first spring coupling part 220 (a rightward direction in FIG. 8) due to axial vibration of the compressor body 100, if the recess part 171*a* contacts the first spring coupling part 220, the compressor body 100 does not move in the rightward direction any more. Therefore, a moving distance in the axial direction of the compressor body 100 is reduced, thereby preventing the first plate spring 210 from being excessively deformed. That is, in this embodiment, the first spring coupling part 220 acts as a "third stopper" limiting a movement in one direction during axial vibration of the compressor body 100.

In this embodiment, the recess part 171*a* is formed in the cover body 171 so as to limit the axial movement of the compressor body 100 while preventing an increase in length in the axial direction of the linear compressor 10. On the other hand, the recess part 171*a* may define a refrigerant opening 173 through which the refrigerant flowing along the refrigerant passage 224 of the first spring coupling part 220 may pass.

Figure 10:
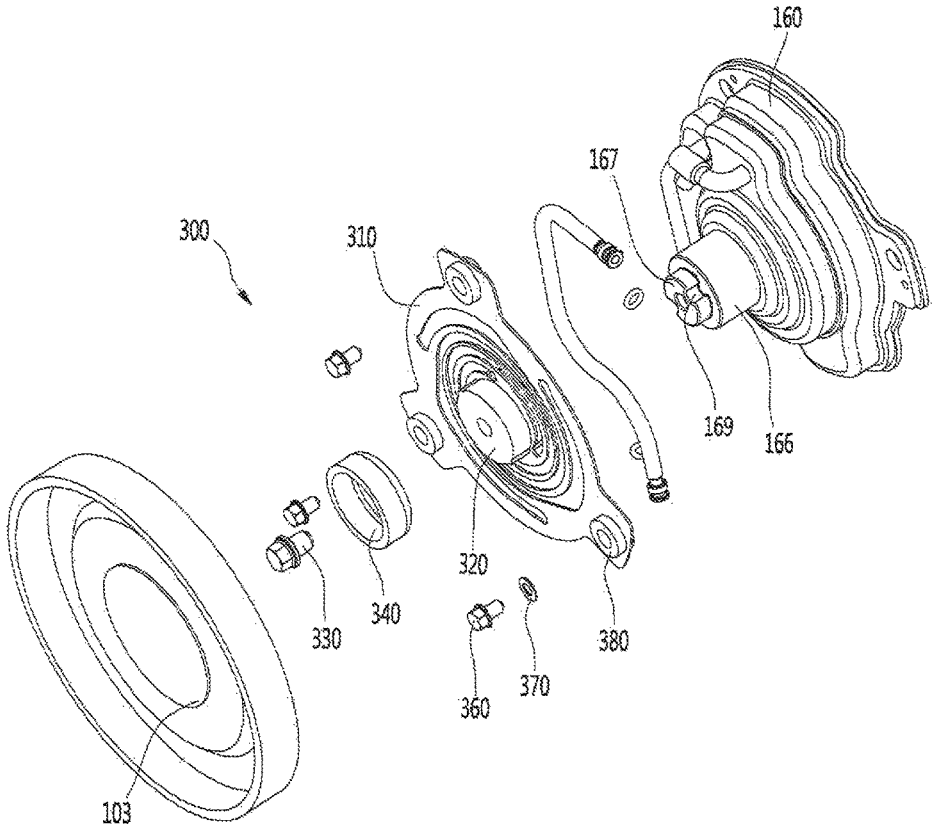
FIGS. 10 and 11 are exploded perspective views illustrating a second support device or support according to an embodiment.
Figure 11:
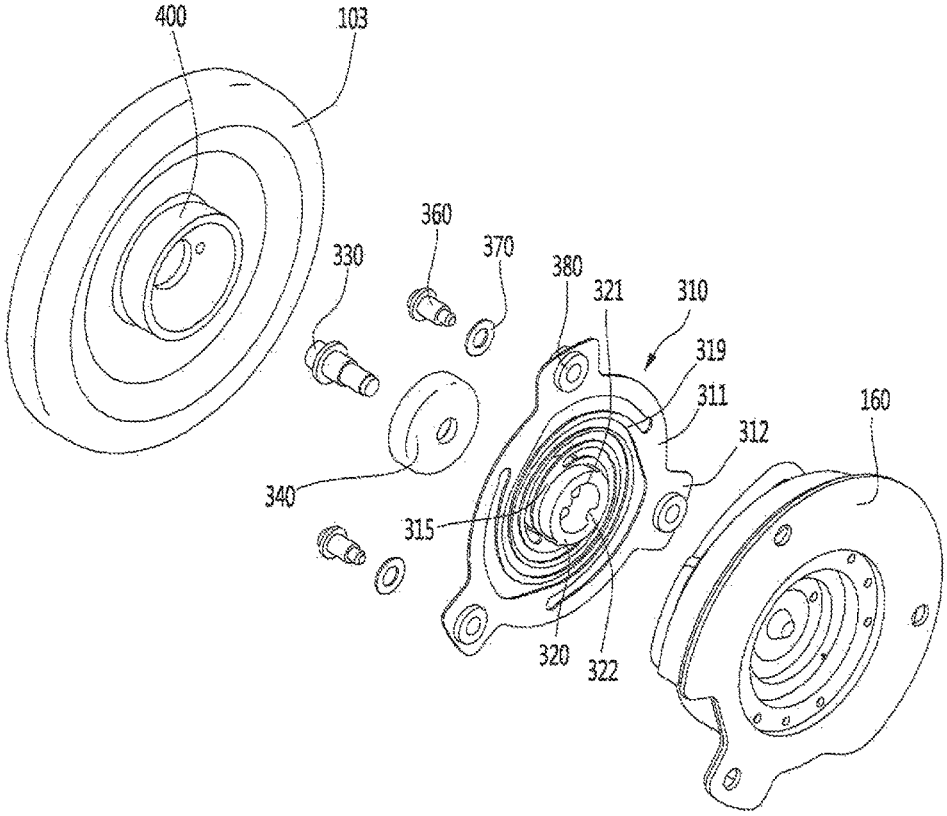
Figure 12:
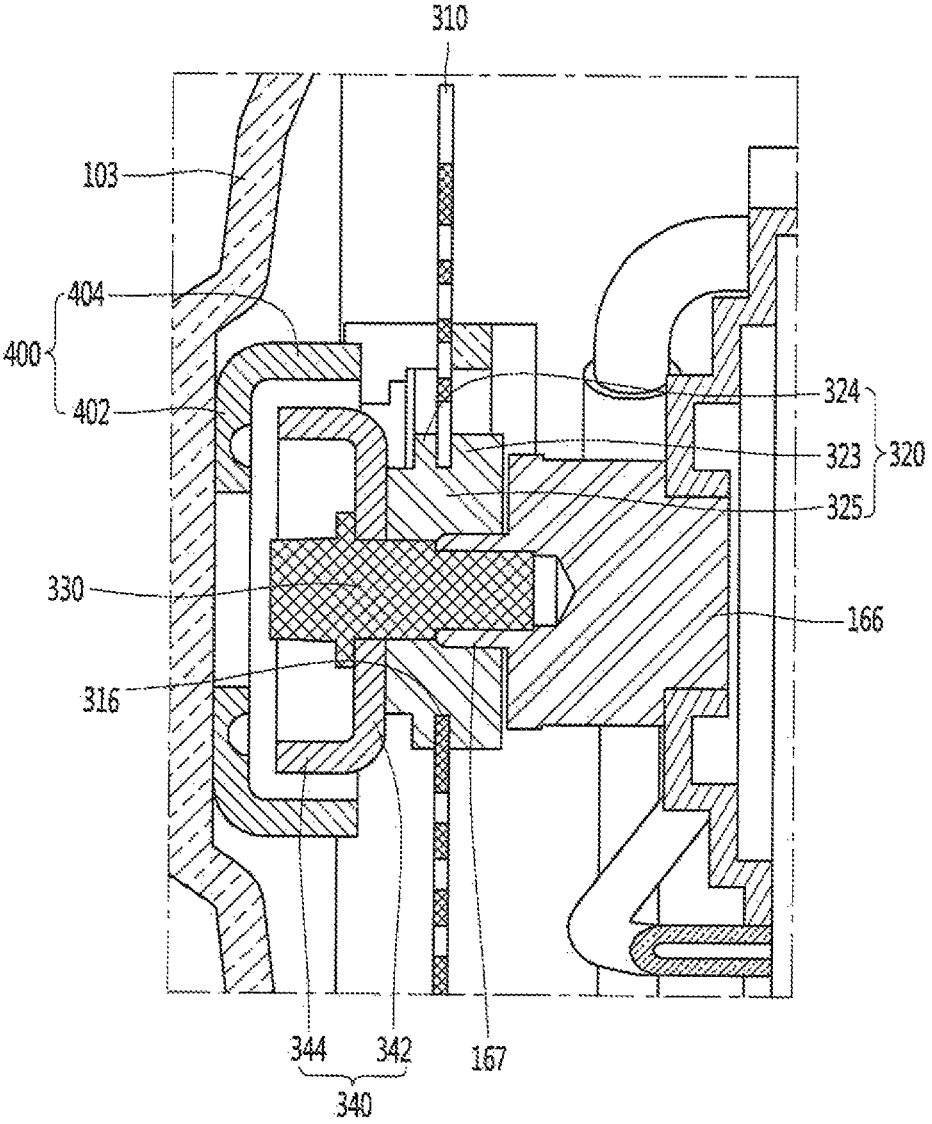
FIG. 12 is a cross-sectional view illustrating a state in which the second support device is coupled to a discharge cover according to an embodiment.

FIGS. 10 and 11 are exploded perspective views of a second support device or support according to an embodiment. FIG. 12 is a cross-sectional view illustrating a state in which the second support device is coupled to the discharge cover according to an embodiment.

Referring to FIGS. 10 to 12, the second support device 300 may be coupled to the shell 101 in a state of being connected to the compressor body 100. The second support device 300 may include a second plate spring 310.

In this embodiment, as the second support device 300 is coupled to the shell 101, a phenomenon in which the compressor body 100 droops down may be reduced. When the drooping of the compressor body 100 is reduced, collision between the compressor body 100 and the shell 101 while the compressor body 100 operates may be prevented.

The second support device 300 may further include a second spring connection part or portion 320 connected to a center of the second plate spring 310. The second spring connection part 320 may be coupled to the discharge cover assembly 160.

The discharge cover assembly 160 may include a cover protrusion 166 to which the second spring connection part 320 may be coupled. The cover protrusion 166 may be integrated with the discharge cover assembly 160 or coupled to the discharge cover assembly 160. As illustrated in FIG. 4, the cover protrusion 166 may be mounted on a central portion of a frontmost (or outermost) discharge muffler 168*b*.

An insertion part or portion 167 inserted into the second spring connection part 320 may protrude from a front surface of the cover protrusion 166. The insertion part 167 may have an outer diameter less than an outer diameter of the cover protrusion 166.

In a state in which the insertion part 167 is inserted into the second spring connection part 320, a projection 322 may be disposed or provided on one of the insertion part 167 or an inner circumferential surface 321 of the second spring connection part 320 to prevent the cover protrusion 166 and the second spring connection part 320 from relatively rotating with respect to each other, and a projection accommodation groove 169 into which the projection 322 may be accommodated may be defined in the other one. For example, FIGS. 10 and 11 illustrate a state in which the projection 322 is disposed or provided on the inner circumferential surface 321 of the second spring connection part 320, and the projection accommodation groove 169 is defined in the insertion part 167.

The second support device 300 may further include a coupling member 330 that couples the second spring connection part 320 to the cover protrusion 166. The coupling member 330 may pass through the second spring connection part 320 and then be coupled to the insertion part 167.

The second spring connection part 320 may be integrally molded to the second plate spring 310 through the injection-molding process, for example. The second spring connection part 320 may be made of a rubber material to absorb vibration, for example.

Thus, the second spring connection part 320 may include first to third portions to prevent the second spring connection part 320 from being separated from the second plate spring 310 in the axial direction of the compressor body 100 in a state in which the second spring connection part 320 is insert-injection-molded to the second plate spring 310. The second spring connection part 320 may include the first portion 323 which extends from an outer circumferential surface of the third portion 325 passing through a hole defined in a center of the second plate spring 310 in the radial direction to come into contact with or contact a first surface of the second plate spring 310 and the second portion 324 which extends from the outer circumferential surface of the third portion 325 in the radial direction to come into contact with or contact a second surface of the second plate spring 310. The second surface may be defined as a surface opposite to the first surface. A diameter of the first portion 323 and the second portion 324 may be greater than a diameter of the inner circumferential surface 316 of the second plate spring 310.

The second plate spring 310 may include an outer rim 311, an inner rim 315, and a plurality of connection parts 319 having a spirally rounded shape and connecting the outer rim 311 to the inner rim 315. More particularly, the plurality of connection parts 319 may be formed by a plurality of spiral holes defined inside of the metal plate having an approximately circular shape.

A hole through which the third portion 325 may pass may be defined in a center of the metal plate having the approximately circular shape. A hole or slit extending in a spiral shape from an outer edge to an inner edge of the metal plate may be defined. A plurality of the hole or slit may be provided to complete the second plate spring 310 having a predetermined elasticity.

That is, an outermost edge of the plurality of holes or slits extending in the spiral shape may be located at a point which is spaced a predetermined distance from an outer edge of the metal plate in a circumferential direction. An innermost edge of the plurality of holes or slits may be located at a point which is spaced a predetermined distance from an inner edge of the metal plate in the circumferential direction. A boundary between the plurality of holes or slits may be defined as the connection part 319. In order to prevent the second spring coupling part 320 from rotating with respect to the second plate spring 310 in a state in which the second spring coupling part 320 is insert-injection-molded to the second plate spring 310, the inner rim 315 may define holes that perform a same function as the plurality of holes 217 defined in the first plate spring 210.

The second plate spring 310 may further include a plurality of fixed parts or portions that extends from an outer circumferential surface of the outer rim 311 in the radial direction.

The second support device 300 may further include a washer 340 fixed to a front surface of the second spring connection part 320 by the coupling member 330. The washer 340 may include a coupling part or portion 342 closely attached to the front surface of the second spring connection part 320 and a bent part or portion 344 bent from an edge of the coupling part 342 to extend toward the second shell cover 103. The bent part 344 may have a cylindrical shape.

A second stopper 400 may be disposed or provided at a center of a rear surface (or an inner surface) of the second shell cover 103. The second stopper 400 (or an additional stopper) may suppress vibration of the compressor body 100 in the axial direction to minimize deformation of the second plate spring 310 and prevent the shell 101 from colliding due to vibration of the compressor body 100 in the radial direction.

The second stopper 400 may include a fixed part or portion 402 fixed to the second shell cover 103 and a restriction part or restrictor 404 bent from the fixed part 402 to extend toward the second plate spring 310. For example, the restriction part 404 may have a cylindrical shape. The restriction part 404 may have an inner diameter greater than an outer diameter of the bent part 344 of the washer 340.

Thus, the bent part 344 of the washer 340 may be accommodated in a region defined by the restriction part 404, and an outer circumferential surface of the bent part 344 of the washer 340 may be spaced apart from an inner circumferential surface of the restriction part 404 of the second stopper 400.

In a state in which the compressor body 100 is not operated, an interval between the outer circumferential surface of the bent part 344 of the washer 340 and the inner circumferential surface of the limiting part 404 of the second stopper 400 may be less than the interval between the stator cover 149 and the shell 101. Therefore, when the compressor body 100 vibrates in the radial direction during the process of operating the linear compressor 10 or the process of transferring the linear compressor 10, the outer circumferential surface of the bent part 344 of the washer 340 contacts the inner circumferential surface of the limiting part 404 of the second stopper 400. Thus, radial movement of the compressor body 100 is limited, thereby preventing the compressor body 100 from colliding with the shell 101.

Also, in a state in which operation of the linear compressor 10 is stopped, the bent part 344 may be spaced apart from the fixed part 402. Thus, while the linear compressor 10 operates, when the compressor body 100 vibrates in the axial direction, the bent part 344 of the washer 340 may come into contact with or contact the fixed part 402 of the second stopper 400 to restrict movement of the compressor body 100 in the axial direction.

For another example, the second stopper 400 may include only the limiting part 404, and the limiting part 404 may be fixed to the second shell cover 103.

The support device 300 may include a buffer part or buffer 380 fitted into the fixed part 312 of the second plate spring 310, a washer 370 disposed or provided on or at a front surface of the buffer part 380, and a coupling bolt 360 (or a coupling member) that passes through the washer 370 and is inserted into the buffer part 380.

Figure 13:
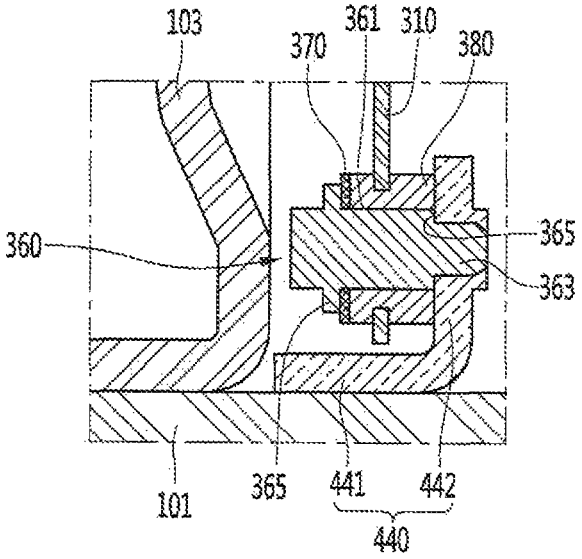
FIG. 13 is a cross-sectional view illustrating a state in which the second support device is coupled to a shell according to an embodiment.

FIG. 13 is a cross-sectional view illustrating a state in which the second support device is fixed to the shell. Referring to FIG. 13, the shell 101 may be provided with a fixing bracket 440 that fixes the second support device 300.

The fixing bracket 440 may include a fixed surface 441 fixed to the shell 101, and a coupling surface bent from the fixed surface 441 to extend in the radial direction of the compressor body 100. A coupling hole 444 to which the coupling bolt 360 may be coupled may be defined in the coupling surface 442.

The buffer part 380 may be coupled to the second plate spring 310 to prevent the vibration of the compressor body 100 in the radial direction from being transmitted to the coupling bolt 360. The buffer part 380 may be integrated with the second plate spring 310 through the insert injection molding, for example. That is, the buffer part 380 may be insert-injection-molded to the second plate spring 310 to form one body in such a manner in which the buffer part 380 is fitted into a hole defined in the fixed part 312. A through-hole 382 through which the coupling bolt 360 may pass may be defined in a center of the buffer part 380.

The coupling bolt 360 may include a body 361 having a cylindrical shape, a coupling part or portion 363 that extends from an end of the body 361 and is coupled to the coupling surface 442, and a head 365 that protrudes from an outer circumferential surface of the body 361. The coupling part 363 may have a diameter less than a diameter of the body 361. Thus, the body 361 may include a stepped surface 362.

The coupling part 363 of the coupling bolt 360 may be coupled to the coupling surface 442 in a state of passing through the buffer part 380. Also, the stepped surface 362 of the body 361 may press the coupling surface 442. Thus, the coupling part 363 may not be coupled to the buffer part 380, and the body may be maintained in a contact state with the buffer part 380.

According to this embodiment, when vibration of the compressor body in the radial direction is transmitted to the buffer part 380, the vibration may be sufficiently absorbed by the buffer part 380 to prevent the vibration from being transmitted to the coupling bolt 360.

The washer 370 may be interposed between the head 365 of the coupling bolt 360 and the buffer part 380. When the coupling part 363 is coupled to the coupling surface 442, the head 365 may press the washer 370. The washer 370 may press the buffer part 380 to the coupling surface 442. Thus, a pressed degree of the buffer part 380 may be secured by a pressing force applied from the head 365. When the pressed degree of the buffer part 380 is secured, vibration of the buffer part 380 itself may be prevented.

Also, in a state in which the buffer part 380 comes into contact with the coupling surface 442, the fixed part 312 of the second plate spring 310 may be spaced apart from the coupling surface in the axial direction. Thus, it may prevent vibration from the fixed part 312 of the second plate spring 310 from being directly transmitted to the coupling surface 442.

According to embodiments disclosed herein, even when the compressor body vibrates in the radial direction in the process of transferring the linear compressor, the first stopper may limit the radial movement of the compressor body. Thus, it is possible to prevent the motor assembly from colliding with the shell, and thus, it is possible to prevent the motor from being damaged.

Further, even when the compressor body vibrates in the radial direction in the process of transferring the linear compressor, the second stopper may limit radial movement of the compressor body. Thus, it is possible to prevent the motor assembly from colliding with the shell, and thus, it is possible to prevent the motor from being damaged.

Furthermore, the back cover supporting the spring unit may include the cover body and the coupling leg, and the first stopper may contact the coupling leg at a position adjacent to the cover body. Thus, it is possible to minimize transfer of an impact between the coupling leg and the first stopper toward the motor.

Also, as the plurality of first stoppers are spaced apart in the circumferential direction of the first shell cover, it is possible to prevent the motor assembly from colliding with the shell, regardless of a vibrating direction of the compressor body. Additionally, as the linear compressor includes the second stopper limiting the axial movement of the compressor body, it is possible to prevent damage caused by excessive deformation of the second plate spring supporting the compressor body.

In a state in which the compressor body and the first support device are coupled to each other, movement of the compressor body may be limited by the first support device when the compressor body moves in the axial direction. Thus, it is possible to prevent damage caused by excessive deformation of the first plate spring constituting or forming the first support device.

Embodiments disclosed herein provide a linear compressor capable of preventing a motor assembly from colliding with a shell in a transfer process or an operation process of a compressor body. Embodiments disclosed herein also provide a linear compressor capable of preventing deformation of a plate spring for supporting a compressor body by limiting an axial movement of a compressor body to a certain range during a transfer process or an operation process of the compressor body.

Embodiments disclosed herein provide a linear compressor that may include a compressor casing including a cylindrical shell and a pair of shell covers that covers both ends of the shell; a frame fixed to an inside of the shell; a cylinder accommodated in the shell and defining a compression space for a refrigerant; a piston inserted into the cylinder to linearly reciprocate in an axial direction of the cylinder and compress the refrigerant provided to the compression space; a motor assembly including a motor that provides power for a linear reciprocating motion to the piston, and a motor support part or support that supports the motor; a spring unit or spring that allows a resonant motion of the piston; a back cover that supports the spring unit; and a stopper provided in one of the pair of shell covers and contacting the back cover when the motor assembly vibrates in a radial direction of the cylinder, thereby preventing the motor assembly from colliding with the shell.

An interval between the stopper and the back cover in the radial direction of the cylinder may be less than a minimum interval between the motor assembly and the shell. The plurality of stoppers may be spaced apart from each other in a circumferential direction of one of the shell covers.

The back cover may include a cover body; and a plurality of coupling legs bent at an edge of the cover body, extending in the axial direction of the cylinder, and spaced apart from each other in a circumferential direction of the cover body. When the motor assembly vibrates in the radial direction of the cylinder, one or more of the plurality of coupling legs may contact one or more of the plurality of stoppers. The one or more of the plurality of coupling legs may contact the one or more of the plurality of stoppers in a region between a line bisecting the coupling legs in the axial direction and the cover body.

The stopper may include a fixing part or portion fixed to one of the shell covers; an extension part or extension bent at an end of the fixing part and extending in a central direction of the shell; and a contact part or contact that extends from an end of the extension part in an extending direction of the coupling leg. The coupling leg may contact the contact part.

The linear compressor may further include a support device or support that couples the back cover to one of the shell covers. The support device may include a plate spring that supports the back cover, and when the back cover moves in the axial direction, the support device may contact the back cover to limit a movement of the back cover.

The plate spring may include an inner rim; an outer rim defined on or at an outer side of the inner rim; and a plurality of coupling parts or portions rounded in a spiral shape to couple the inner rim to the outer rim and spaced apart from each other in a circumferential direction of the plate spring.

The support device may include a spring coupling part or portion that passes through the inner rim, fixed to the inner rim, and coupled to one of the shell covers; and a back cover coupling member that couples the back cover to the outer rim and maintaining a state in which the plate spring is spaced apart from the back cover. When the back cover moves in the axial direction, the back cover may be contactable with the spring coupling part.

A recess part or recess may be recessed in a direction far away from one of the shell covers in an inside of the cover body. When the back cover moves in the axial direction, the spring coupling part may contact the recess part.

The linear compressor may further include a discharge cover assembly which may be coupled to the motor support part and from which the compressed refrigerant may be discharged; a support device or support that couples the discharge cover assembly to the shell and supports the compressor body; and an additional stopper provided in the other of the pair of shell covers and preventing the motor assembly from colliding with the shell. When the motor assembly vibrates in the radial direction, the additional stopper may be contactable with a portion of the support device. The additional stopper may include a cylindrical limiting part or portion, and the support device may include a washer that contacts the limiting part when the motor assembly vibrates in the radial direction.

The discharge cover assembly may include a discharge cover that accommodates the refrigerant discharged from the compression space; a discharge muffler disposed or provided on or at a front side of the discharge cover; and a cover protrusion that protrudes from a front surface of the discharge muffler. The support device may include a plate spring that supports the discharge cover assembly, and a spring coupling part or portion fixed to a center of the plate spring and supporting the cover protrusion.

The washer may include a fixing portion fixed to a front surface of the spring coupling part, and a cylindrical bent part or portion which may be bent and extend from an edge of the fixing part. An external diameter of the bent part may be less than an internal diameter of the limiting part. The additional stopper may include a fixing part or portion fixed to the other of the shell covers. The limiting part may extend from the edge of the fixing part. The bent part and the fixing part may be spaced apart in the axial direction of the cylinder. When the compressor body vibrates in the axial direction, the bent part may be contactable with the fixing part.

The details of one or more embodiments are set forth in the accompanying drawings and the description. Other features will be apparent from the description and drawings, and from the claims.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a compressor casing including a cylindrical shell and a pair of shell covers that covers ends of the shell;

a frame fixed to an inside of the shell;

a cylinder accommodated in the shell and defining a compression space for a refrigerant;

a piston inserted into the cylinder to linearly reciprocate in an axial direction of the cylinder and compress the refrigerant provided to the compression space;

a motor assembly including a motor that provides power for a linear reciprocating motion to the piston, and a motor support that supports the motor;

at least one spring that allows a resonant motion of the piston;

a back cover that supports the at least one spring; and a plurality of stoppers which is provided in one of the pair of shell covers and contacts the back cover when the motor assembly vibrates in a radial direction of the cylinder, thereby preventing the motor assembly from colliding with the shell, wherein an interval between the plurality of stoppers and the back cover in the radial direction of the cylinder is less than a minimum interval between the motor assembly and the shell, wherein the plurality of stoppers is spaced apart from each other in a circumferential direction of the one of the pair of shell covers, wherein the back cover includes:

a cover body; and a plurality of coupling legs spaced apart from each other in a circumferential direction of the cover body, each coupling leg of the plurality of coupling legs being bent at an edge of the cover body and extending in the axial direction of the cylinder, and wherein, when the motor assembly vibrates in the radial direction of the cylinder, one or more of the plurality of coupling legs contact one or more of the plurality of stoppers.

2. The linear compressor according to claim 1 further including a support that couples the back cover to one of the pair of shell covers, wherein the support includes a plate spring that supports the back cover, and when the back cover moves in the axial direction, the support contacts the back cover to limit a movement of the back cover.

3. The linear compressor according to claim 1, further including:

a discharge cover assembly which is coupled to the motor support and through which the compressed refrigerant is discharged;

a support that couples the discharge cover assembly to the shell and supports a compressor body; and an additional stopper provided in the other of the pair of shell covers, wherein the additional stopper prevents the motor assembly from colliding with the shell, and wherein, when the motor assembly vibrates in the radial direction, the additional stopper is contactable with a portion of the support, wherein the additional stopper includes a cylindrical limiting portion, and the support includes a washer that contacts the limiting portion when the motor assembly vibrates in the radial direction.

4. A linear compressor, comprising:

a compressor casing including:

a cylindrical shell horizontally disposed; and a pair of shell covers that covers both ends of the shell;

a compressor body horizontally received in the cylindrical shell, the compressor body including:

a frame fixed at an inside of the shell;

a cylinder accommodated in the shell and defining a compression space for a refrigerant;

a piston inserted into the cylinder to linearly reciprocate in an axial direction of the cylinder and compress the refrigerant provided to the compression space, the axial direction being defined as a horizontal direction;

a motor assembly including a motor that provides power for a linear reciprocating motion to the piston, and a motor support that supports the motor;

at least one spring that allows a resonant motion of the piston; and a back cover that supports the at least one spring; and a plurality of stoppers, which is provided in one of the pair of shell covers, is spaced apart from each other in a circumferential direction of one of the pair of shell covers, wherein the back cover includes:

a cover body; and a plurality of coupling legs spaced apart from each other in a circumferential direction of the cover body, each coupling leg of the plurality of coupling legs being bent at an edge of the cover body and extending in the axial direction of the cylinder, wherein, when the motor assembly vibrates in a radial direction of the cylinder, one or more of the plurality of coupling legs contact one or more of the plurality of stoppers, thereby preventing the motor assembly from colliding with the shell.

5. The linear compressor according to claim 1, wherein an interval between the at least one stopper and the back cover in the radial direction of the cylinder is less than a minimum interval between the motor assembly and the shell.

6. The linear compressor according to claim 1, wherein the one or more of the plurality of coupling legs contacts the one or more of the plurality of stoppers in a region between a vertical plane bisecting the plurality of coupling legs in the axial direction and the cover body.

7. The linear compressor according to claim 1, wherein each of the plurality of stoppers includes:

a fixing portion fixed to one of the shell covers;

an extension which is bent at an end of the fixing portion and extends in a central direction of the shell; and a contact portion that extends from an end of the extension in an extending direction of the plurality of coupling legs, wherein a respective one of the plurality of coupling legs contacts the contact portion.

8. The linear compressor according to claim 1, further including a support that couples the back cover to one of the pair of shell covers, wherein the support includes a plate spring that supports the back cover, and when the back cover moves in the axial direction, the support contacts the back cover to limit a movement of the back cover.

9. The linear compressor according to claim 8, wherein the plate spring includes:

an inner rim;

an outer rim defined on an outer side of the inner rim; and a plurality of coupling portion rounded in a spiral shape to couple the inner rim to the outer rim and spaced apart from each other in a circumferential direction of the plate spring.

10. The linear compressor according to claim 9, wherein the support includes:

a spring coupling portion that passes through the inner rim, is fixed to the inner rim, and is coupled to one of the pair of shell covers; and a back cover coupling member that couples the back cover to the outer rim and maintains a state in which the plate spring is spaced apart from the back cover, wherein, when the back cover moves in the axial direction, the back cover is contactable with the spring coupling portion.

11. The linear compressor according to claim 10, wherein a recess is recessed in a direction away from one of the pair of shell covers at a surface of the cover body, and when the back cover moves in the axial direction, the spring coupling portion contacts the recess.

12. The linear compressor according to claim 1, further including:

a discharge cover assembly which is coupled to the motor support and through which the compressed refrigerant is discharged;

a support that couples the discharge cover assembly to the shell and supports the compressor body; and an additional stopper provided in the other of the pair of shell covers, wherein the additional stopper prevents the motor assembly from colliding with the shell, and wherein, when the motor assembly vibrates in the radial direction, the additional stopper is contactable with a portion of the support.

13. The linear compressor according to claim 12, wherein the additional stopper includes a cylindrical limiting portion, and the support includes a washer that contacts the limiting portion when the motor assembly vibrates in the radial direction.

14. The linear compressor according to claim 13, wherein the discharge cover assembly includes:

a discharge cover that accommodates the refrigerant discharged from the compression space;

a discharge muffler provided at a front side of the discharge cover; and a cover protrusion that protrudes from a front surface of the discharge muffler, and wherein the support includes:

a plate spring that supports the discharge cover assembly; and a spring coupling portion which is fixed to a center of the plate spring and supports the cover protrusion.

15. The linear compressor according to claim 14, wherein the washer includes:

a fixing portion fixed to a front surface of the spring coupling portion; and a cylindrical bent portion which is bent and extends from an edge of the fixing portion, and wherein an external diameter of the bent portion is less than an internal diameter of the limiting portion.

16. The linear compressor according to claim 15, wherein the additional stopper further includes a fixing portion fixed to the other of the pair of shell covers, wherein the limiting portion extends from the edge of the fixing portion, wherein the bent portion and the fixing portion are spaced apart in the axial direction of the cylinder, and when the compressor body vibrates in the axial direction, the bent portion is contactable with the fixing portion.

* * * * *